US006129225A

United States Patent [19]

Giannoglou et al.

[11] Patent Number: 6,129,225

[45] Date of Patent: Oct. 10, 2000

[54] MICROCELL MODULE LIFTING AND POSITIONING SYSTEM

[75] Inventors: Peter Giannoglou, Montclair; Alfred F. Miller, Neshanic Station; Alexander Petrunia, Madison, all of N.J.

[73] Assignee: Lucent Technologies, Inc., Murray Hill, N.J.

[21] Appl. No.: 09/178,976

[22] Filed: Oct. 26, 1998

[51] Int. Cl.[7] ..... B66C 23/18

[52] U.S. Cl. ..... 212/179; 248/218.4

[58] Field of Search ..... 212/272, 273, 212/179, 71; 248/218.4, 219.1

[56] References Cited

U.S. PATENT DOCUMENTS

| | | | |
|---|---|---|---|
| 807,164 | 12/1905 | Gould et al. | 212/179 |
| 971,686 | 10/1910 | Michael et al. | 212/179 |
| 1,835,623 | 12/1931 | Wright et al. | 212/179 |
| 2,381,913 | 8/1945 | Leaver et al. | 212/179 |
| 3,239,183 | 3/1966 | Price et al. | 248/218.4 |
| 3,266,775 | 8/1966 | Coe | 212/179 |
| 3,474,995 | 10/1969 | Amidon et al. | 248/218.4 |
| 3,856,250 | 12/1974 | Farmer | 248/221 |
| 4,103,853 | 8/1978 | Bannan | 248/219.1 |
| 4,684,031 | 8/1987 | Bergman et al. | 212/179 |
| 5,056,673 | 10/1991 | Williams | 212/179 |
| 5,641,141 | 6/1997 | Goodwin | 248/218.4 |

FOREIGN PATENT DOCUMENTS

| | | | |
|---|---|---|---|
| 5-85694 | 9/1991 | Japan | 212/273 |

*Primary Examiner*—Thomas J. Brahan
*Attorney, Agent, or Firm*—J. De La Rosa

[57] ABSTRACT

The present invention is directed to a lifting and positioning system for use by a single person in installing onto or removing from an elevated position a microcell module, all without the aid of major powered machinery. In addition to the use of a portable hoist, a bracket for permanently mounting the microcell module to a desired surface at the installation site, and a lifting bracket that detachably mounts to the module, the lifting and positioning system of the present invention uses structural features of the microcell module itself to simplify installation and removal. In this latter manner, only a relatively small number of parts need to be carried to the installation site, and can be done so safely and without undue bodily strain.

29 Claims, 3 Drawing Sheets

MICROCELL MODULE LIFTING AND POSITIONING SYSTEM

TECHNICAL FIELD

The present invention relates to a lifting and positioning system, and more particularly, to a lifting and positioning system for installing and removing, for example, microcell modules used in cellular communication networks.

BACKGROUND OF THE INVENTION

Cellular communication networks commonly have telephony base stations enclosed in a so-called "microcell module" 10 which typically need to be positioned and mounted onto a wall, pole, or tower 20, as shown in FIG. 1. Yet, such microcell modules can be quite heavy, with installation often requiring the use of cranes, hoists and other lifting systems. Moreover, even with the use of such equipment, installation typically still requires more than one person.

Accordingly, there exists a need for a lifting and positioning system which allows a single person to safely lift, position, and then secure the microcell module, and, in general, an equipment module, to the desired installation site.

SUMMARY OF THE INVENTION

An object of the present invention is to provide a lifting and positioning system for use by a single person in installing to or removing from an elevated position a microcell module, all without the aid of major powered machinery. In addition to the use of a portable hoist, the lifting and positioning system of the present invention uses structural features of the microcell module itself to simplify installation and removal.

In the preferred embodiment, the lifting and positioning system includes at least a portable hoist, a mounting bracket, and a lifting bracket which support the microcell module during a lifting operation. The portable hoist includes a lifting arm sufficiently strong to support the weight of the microcell module during a lifting operation, as well as a trolley equipped with a winch that slides along the length of the shaft of the lifting arm for lifting and positioning the microcell module.

Prior to a lifting operation, the mounting bracket is carried to the installation site, and permanently fastened to the desired surface. Preferably, the mounting bracket is "U-shaped" and at least includes a vertical member as well as upper and lower horizontal rail members. Affixed permanently to the top and bottom surfaces of the microcell module are guide rail channels which slidably receive the upper and lower horizontal rail members that support the weight of the microcell module after installation. During a lifting operation, the mounting bracket is fastened to the lifting arm using attachment holes in the upper horizontal rail member so as to support the hoist.

Slidably mounted on the lifting arm is the trolley which is equipped with a winch and is partially opened along a slot to allow a lifting line to engage the lifting bracket. To effect lifting, the lifting line is connected from the winch to the top of the lifting bracket, and the winch then engaged to raise the module into its uppermost position. Once the mounting bracket has been mounted to the desired surface and the portable hoist attached thereto, the lifting bracket is then temporarily fastened to the microcell module. Next, the lifting bracket is temporarily attached to the microcell module by aligning captive screws through mounting holes in the lifting bracket.

During a lifting operation, the lifting line is unspooled through the bottom of the trolley until it reaches the microcell module. This is effected using the winch which serves to spool and unspool the lifting line, and operates in a ratcheting fashion through the manual activation of a crank, or alternatively, can be motorized. The winch spools the lifting line so as to lift the microcell module until it engages a bottom recess in the trolley. Preferably, deflection panels extending outwardly serve to guide and align the top of lifting bracket into the bottom recess. As the trolley is rolled along the shaft of the lifting arm, the horizontal rail members of the mounting bracket slidably engage the guide rail channels, with the rail members then permanently secured to the guide rail channels using fasteners. The lifting bracket is next detached, and then, the trolley removed. Next, the lifting arm is detached from the mounting bracket, and, in a likewise manner, the lifting bracket removed.

BRIEF DESCRIPTION OF THE DRAWINGS

The features and advantages of the present invention will become more readily apparent from the following detailed description of the invention in which like elements are labeled similarly and in which.

DETAILED DESCRIPTION OF THE INVENTION

Without any loss of generality or applicability for the principles of the present invention, the embodiment herein below is principally directed to a lifting and positioning system for a so-called "microcell module" which typically needs to be positioned and mounted onto, for example, a wall, pole, or tower. Those skilled in the art will readily note that such a "microcell module" typically contains at least a telephony base station used, for example, in cellular communication networks. It should, however, be clearly understood that the present lifting and positioning system is equally applicable to other types of modules, such as electronic and optical modules and, in general, equipment modules.

Advantageously, a single person using the lifting and positioning system of the present invention can safely install onto or remove from an elevated position a microcell module, all without the aid of major powered machinery. In addition to the use of a portable hoist, a bracket for permanently mounting the microcell module to a desired surface at the installation site, and a lifting bracket that detachably mounts to the module, the lifting and positioning system of the present invention uses structural features of the microcell module itself to simplify installation and removal. In this latter manner, only a relatively small number of parts need to be carried to the installation site, and can be done so safely and without undue bodily strain.

Figure 1:
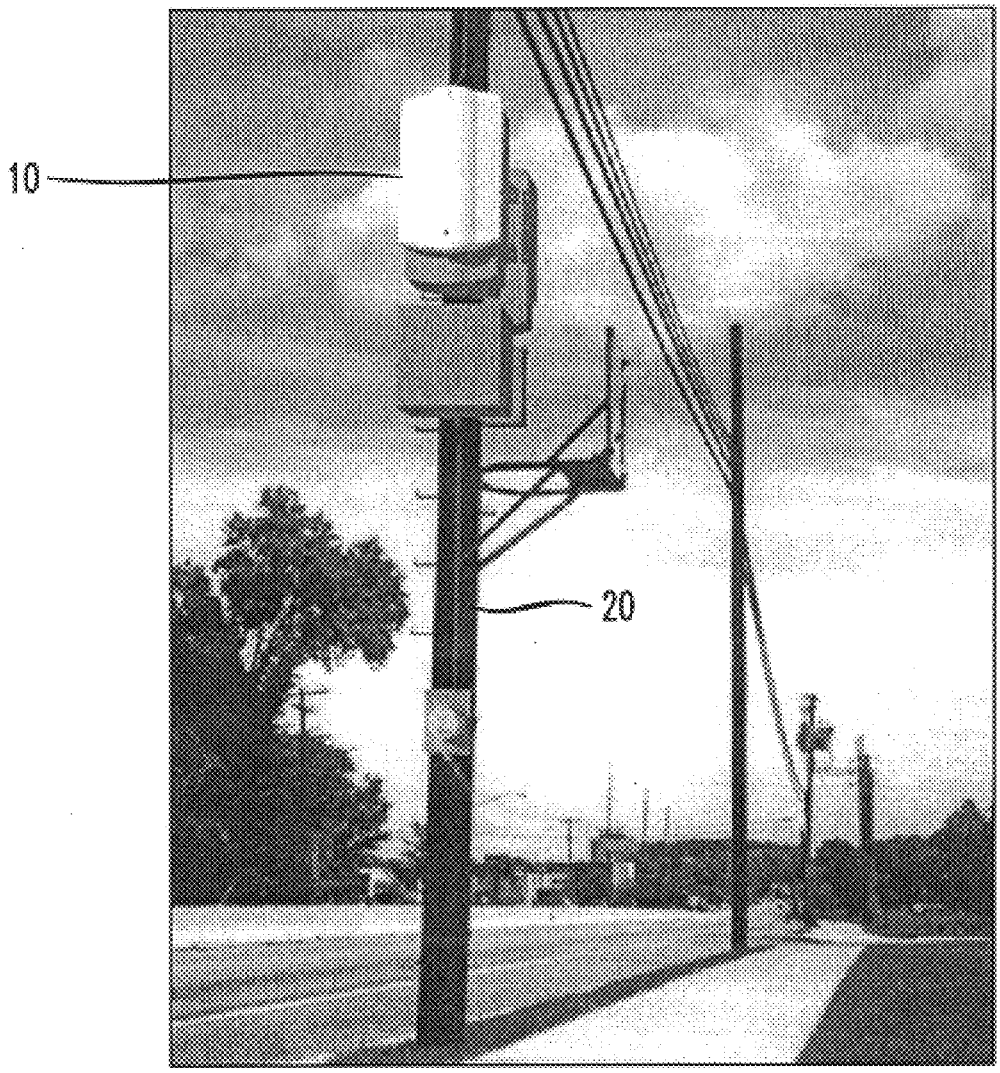
FIG. 1 PRIOR ART
FIG. 1 is a perspective view of an exemplary microcell module installed on a pole.
Figure 2:
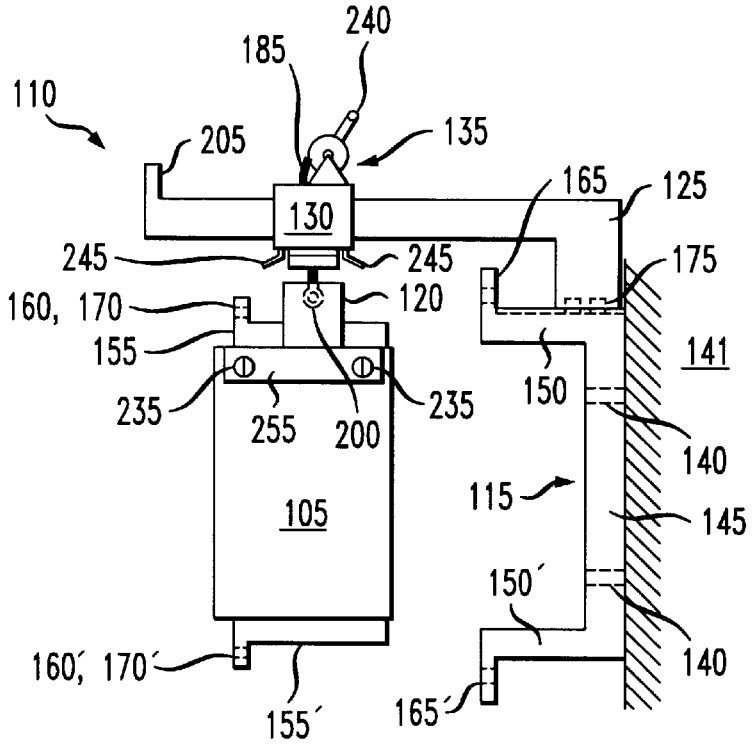
FIG. 2 is a side view of an embodiment of a lifting and positioning system according to the present invention during a lifting operation.
Figure 4:
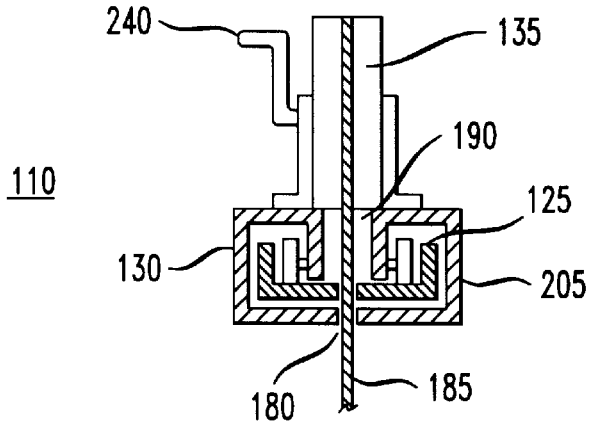
FIG. 4 is a cross section view of the portable hoist of FIGS. 2 and 3.
Figure 3:
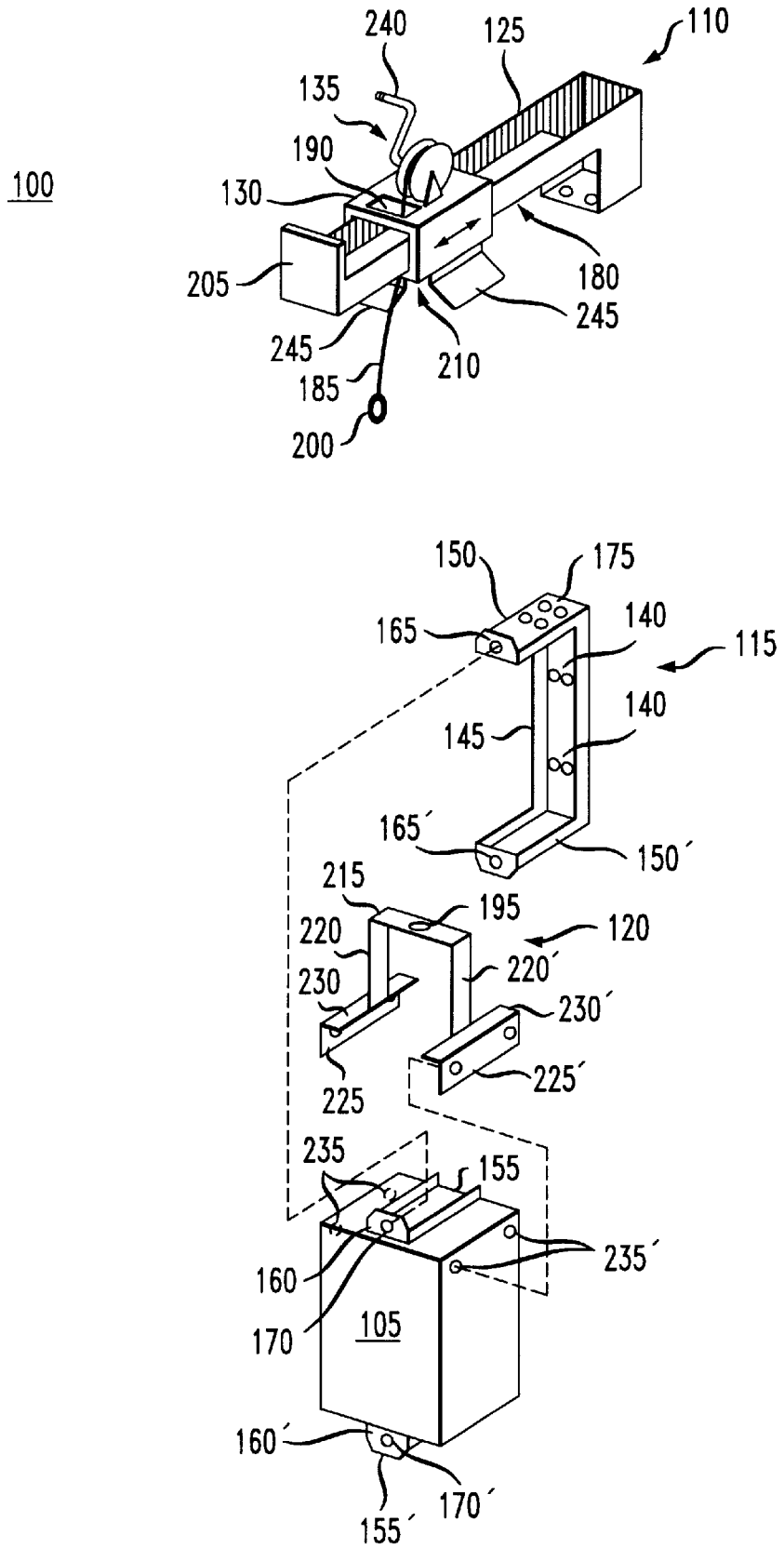
FIG. 3 is a perspective view of the lifting and positioning system of FIG. 2 in a partially disassembled state.

More specifically, shown in FIGS. 2–4 is an exemplary embodiment of a lifting and positioning system 100 in accordance with the principles of the invention. In FIG. 2, lifting and positioning system 100 is illustrated in the process of lifting a load, such as a microcell module 105. Shown in FIG. 3 is the lifting and positioning system of FIG. 2 in a partially disassembled state. For the sake of clarity, however, the portable hoist of the system is shown in greater detail in FIG. 4.

Lifting and positioning system 100 includes at least a portable hoist 110, a mounting bracket 115, and a lifting bracket 120 which support microcell module 105 during a lifting operation. Portable hoist 110 may be motorized, but at least includes a lifting arm 125 sufficiently strong to support the weight of microcell module 105 during a lifting operation. Although depicted as a single section, it is contemplated that lifting arm 125 can be composed of a plurality of rigid telelescoping tube sections, each, for example, of a rectangular cross section. Portable hoist includes as well a trolley 130 equipped with a winch 135 that slides along the length of the shaft of lifting arm 125 for lifting and positioning microcell module 105 relative to mounting bracket 115.

Prior to a lifting operation, mounting bracket 115 is carried to the installation site, such as on a ladder, and permanently fastened through mounting holes 140 using suitable screws or bolts to a desired surface, such as onto an installation surface 141 of a pole. Alternatively, mounting bracket 115 may be fastened to the surface of a building or tower, among other things. It should be clearly understood that mounting bracket 115 later connects to microcell module 105 to secure the module permanently against installation surface 141. Mounting bracket 115 can be made of any material of sufficient strength to support microcell module 105 during lifting. Extruded steel is particularly well suited because of its high strength to weight ratio. Preferably, mounting bracket 115 is "U-shaped" and at least includes vertical member 145 as well as upper and lower horizontal rail members 150, 150', respectively.

Affixed permanently to the top and bottom surfaces of microcell module 105 are top and bottom guide rail channels 155,155', which slidably receive upper and lower horizontal rail members 150,150', respectively. Note that horizontal rail members 150,150' support the weight of microcell module 105 after installation. Located at the ends of guide rail channels 155,155' are upper and lower stops 160,160' against which each respective end of horizontal rail members 150,150' is seated. When seated properly against stops 160,160', corresponding upper and lower mounting holes 165,165' located at the ends of upper and lower horizontal rail members 150,150', respectively, align with upper and lower mounting holes 170,170'. In order to assist the user in aligning the mounting holes, a detent mechanism, of course, may be used.

During a lifting operation, mounting bracket 115 is fastened to guide rail channels 155,155' using properly dimensioned bolts at mounting holes 170,170' that extend through mounting holes 165,165', with a nut thereafter threaded onto each bolt. Alternatively, quick-release pins may be inserted through the mounting holes. Located on upper horizontal rail member 150 are attachment holes 175 used to support and temporarily fasten portable hoist 110 to mounting bracket 115 during a lifting operation. More specifically, portable hoist 110 is detachably connected to mounting bracket 115 using captive screws that extend from lifting arm 125 and into attachment holes 175.

In this embodiment, portable hoist 110 includes lifting arm 125 having a generally quadrilateral cross section which remains constant over its length, although other configurations are readily adaptable for the purposes of this invention. Slidably mounted on lifting arm 125 is trolley 130 composed of the union of planar panels defining a quadrilateral shaped channel which is partially open along a slot 180, thereby allowing a lifting line 185 to pass through an opening 190 along the top to engage lifting bracket 120, as shown in more detail in FIG. 4. Lifting line 185 may be any form of flexible lead, such as a rope, chain, cable, or wire. When mounted, lifting arm 125 is oriented with its longitudinal axis generally normal to installation surface 141 onto which microcell module 105 is to be mounted. To effect lifting, lifting line 185 is connected through an opening 195 in the top of lifting bracket 120, with a detachable loop 200 then threaded at the end of the lifting line. Winch 135 may then be engaged to raise the module into its uppermost position, as discussed herein below.

Although the channel of trolley 130 slidably receives the shaft of lifting arm 125, it is dimensioned to prevent any significant rotational and/or rocking motions. During a lifting operation, a front stop 205 is installed onto the free end of lifting arm 125 to prevent trolley 130 from detaching. Alternatively, stop 205 may be permanently attached. Preferably, trolley 130 includes a bottom recess 210 for receiving the upper portion of lifting bracket 120. During lifting, trolley 130 is horizontally offset from mounting bracket 115 to allow clearance therebetween.

Once mounting bracket 115 has been mounted to installation surface 141 and portable hoist 110 attached thereto, lifting bracket 120 is then temporarily fastened to microcell module 105. Preferably, lifting bracket 120 is shaped as a squared-off inverted letter "U" composed of the union of a horizontal member 215, and two vertical members 220,220'. Of course, other shapes and configurations can be used for mounting lifting bracket 120 to microcell module 105. At the ends of vertical members 220,220' are appropriately dimensioned "L-shaped" support brackets 225,225'. Lifting bracket 120 is temporarily attached to microcell module 105 by aligning captive screws through mounting holes 230,230' into threaded holes 235,235', and then turning the screws until properly seated.

During a lifting operation, lifting line 185 is unspooled through the bottom of trolley 130 until it reaches microcell module 105, which is typically located on or near the ground. This is effected using winch 135, which serves to spool and unspool lifting line 185, and operates in a ratcheting fashion through the manual activation of a crank 240. If desired, trolley 130 may only consist of a pulley wherein lifting line 185 is spooled and unspooled by means located below the installation site. In either case, the free end of lifting line 185 is temporarily attached to the lifting bracket 120 through attachment hole 195 using detachable loop 200. Winch 135 spools lifting line 185 so as to lift microcell module 105 until horizontal member 215 engages and fits snugly into bottom recess 210. Such engaging means includes dimensioning lifting arm 125 and mounting bracket 115 such that guide rail channels 155,155' align with horizontal rail members 150,150', when microcell module 105 properly engages bottom recess 210. Also, properly dimensioned deflection panels 245 extending outwardly serve to guide and align the top of lifting bracket 120 into bottom recess 210. Deflections panels 245 also serve to properly orient microcell module 105 such that guide rail channels 155,155' are substantially parallel with horizontal rail members 150,150'.

In positioning the microcell module, trolley 130, which now supports the weight of microcell module 105, is rolled along lifting arm 125 in a direction away from stop 205. As trolley 130 is rolled, horizontal rail members 150,150' slidably engage guide rail channels 155,155'. For safety reasons, trolley 130 may be detachably secured to the rail members by an engaging member, such as a quick-release pin which passes through a hole formed in the side of one of the rail members and into the lifting arm. Guide rail channels 155,155' are then secured to mounting bracket 115 using fasteners that engage holes 165,165' in mounting bracket 115 and holes 170,170' in guide rail channels 155,155'.

Once microcell module 105 is permanently fastened to mounting bracket 115, lifting bracket 120 is detached, and then, stop 205 removed from lifting arm 125, thereby allowing trolley 130 to be removed and carried to the ground. Next, lifting arm 125 is detached from mounting bracket 115, and, in a likewise manner, lifting bracket 120 then detached and removed from trolley 130. If desired, portable hoist 115, however, can be detached from mounting bracket 115 without first having to disassemble trolley 130 from lifting arm 125.

As described above herein, the present lifting and positioning system advantageously allows a single person to safely lift, position, and then secure the microcell module to the desired installation site.

Those skilled in the art will readily note that by reversing the operation of the above described lifting and positioning system, the microcell module may be removed from the installation site. Also, while the invention has been described herein with regard to a preferred embodiment, the invention is not limited thereby, but is only limited by the claims provided below.

It should be understood that many changes, modification, variations and other uses and applications will become apparent to those skilled in the art after considering this specification and the accompanying drawings. For example, although the microcell module has been depicted as being rectangular in shape, it should be clearly understood that any shaped module can be used.

What is claimed is:

1. A system for lifting and positioning an equipment module comprising:

a portable hoist supporting at least a winch and lifting line, said winch slidably mounted on a lifting arm;

guide rail channels disposed on said equipment module;

a substantially "U-shaped" mounting bracket fastened to a desired surface, said mounting bracket including attachment means for detachably supporting said portable hoist during lifting, and including rail members which slidably engage said guide rail channels for permanently supporting said equipment module on the desired surface; and a lifting bracket detachably mounted to said equipment module and detachably connected to said lifting line for lifting and positioning said equipment module relative to said mounting bracket when said portable hoist is engaged.

2. The system of claim 1 wherein said lifting arm, mounting bracket and lifting bracket are dimensioned such that said guide rail channels are substantially aligned with said rail members when said equipment module is raised to an uppermost position.

3. The system of claim 1 wherein said equipment module is a microcell module.

4. The system of claim 1 further including a trolley slidably attached along a shaft of the lifting arm of said portable hoist, said trolley equipped with said winch and lifting line.

5. The system of claim 4 wherein said shaft of the lifting arm is dimensioned so as to prevent said trolley from substantially rotating or rocking about said shaft.

6. The system of claim 4 wherein said trolley includes a bottom recess for receiving an upper portion of said lifting bracket.

7. The system of claim 4 further including deflection panels extending outwardly along a bottom portion of said trolley for guiding the equipment module into align therewith.

8. The system of claim 1 wherein said mounting bracket includes mounting holes for mounting said mounting bracket to the desired surface.

9. The system of claim 1 wherein said guide rail channels include stops.

10. The system of claim 1 wherein the lifting arm of said portable hoist is oriented with its longitudinal axis substantially normal to the desired surface.

11. The system of claim 1 wherein said lifting bracket is shaped substantially as an inverted "U."

12. The system of claim 1 wherein said lifting bracket is composed of the union of a horizontal member and two vertical members, each of said vertical members having an "L" shaped support bracket for attaching to said equipment module.

13. The system of claim 1 wherein said winch includes a crank operating in a ratcheting manner for spooling and unspooling the lifting line.

14. A lifting and positioning system comprising:

a lifting arm having a slot along a portion of the length of said lifting arm;

guide rail channels attached to a load;

a substantially "U-shaped" mounting bracket fastened to a desired surface for permanently securing the load against the desired surface, said mounting bracket having first attachment means for detachably supporting said lifting arm, and having rail members which slidably engage said guide rail channels;

a trolley having a winch, said trolley slidably mounted on said lifting arm;

a cable having first and second ends, said first end being mounted on said winch, with said cable extending through said slot in said lifting arm; and a lifting bracket detachably mounted to the load, and having second attachment means for detachably connecting to the second end of said cable, wherein a spooling of said cable onto said winch lifts said load into an uppermost position such that said rail members align with said guide rail channels.

15. The system of claim 14 wherein said load is an equipment module.

16. The system of claim 14 wherein said lifting arm is dimensioned so as to prevent said trolley from substantially rotating or rocking.

17. The system of claim 14 wherein said trolley includes a bottom recess for receiving an upper portion of said lifting bracket.

18. The system of claim 14 wherein said first and second attachment means includes mounting holes.

19. The system of claim 14 wherein said guide rail channels include stops.

20. The system of claim 14 wherein the lifting arm is oriented with its longitudinal axis substantially normal to the desired surface.

21. The system of claim 14 wherein said lifting bracket is shaped substantially as an inverted "U."

22. The system of claim 14 wherein said lifting bracket is composed of the union of a horizontal member and two vertical members, each of said vertical members having an "L" shaped support bracket for attaching to said load.

23. The system of claim 14 wherein said winch includes a crank operating in a ratcheting manner for spooling and unspooling the cable.

24. The system of claim 14 further including deflection panels extending outwardly along a bottom portion of said trolley for guiding the load its uppermost position.

25. An improved method for lifting and positioning a load onto a desired surface, said method comprising the steps of:

mounting guide rail channels to the load;

shaping a mounting bracket as a "U-shape;"

fastening the mounting bracket to the desired surface, said mounting bracket having rail members which slidably engage said guide rail channels;

detachably supporting a portable hoist on said mounting bracket, said hoist including a trolley with a winch slidably mounted on the shaft of the lifting arm, and including a cable having first and second ends, said first end being mounted on said winch, and said cable extending through a slot in the lifting arm;

detachably fastening the second end of the cable to a lifting bracket supporting said load during a lifting operation;

detachably fastening the lifting bracket to the load;

spooling the cable onto the winch so as to lift the load into an uppermost position wherein the rail members align with the guide rail channels;

rolling the trolley along the lifting arm until the rail members engage the guide rail channels; and detaching the lifting bracket from the load.

26. The method of claim 25 further including providing said load as an equipment module.

27. The method of claim 25 further comprising the step of providing the trolley with a bottom recess for receiving an upper portion of the lifting bracket.

28. The method of claim 25 further including the step of shaping said lifting bracket as an inverted "U."

29. The method of claim 25 further comprising the step of providing deflection panels extending outwardly along a bottom portion of said trolley for guiding the load into align therewith.

* * * * *